US008348641B2

(12) United States Patent
Jansen

(10) Patent No.: US 8,348,641 B2
(45) Date of Patent: Jan. 8, 2013

(54) PISTON COMPRESSOR

(75) Inventor: Paul Jansen, Kerkrade (NL)

(73) Assignee: Neuman & Esser Maschinenfabrik GmbH & Co. KG, Ubach-Palenberg (DE)

( * ) Notice: Subject to any disclaimer, the term of this patent is extended or adjusted under 35 U.S.C. 154(b) by 710 days.

(21) Appl. No.: 12/387,411

(22) Filed: May 1, 2009

(65) Prior Publication Data

US 2009/0274569 A1 Nov. 5, 2009

(30) Foreign Application Priority Data

May 5, 2008 (DE) ..... 10 2008 001 540

(51) Int. Cl.
*F04B 53/16* (2006.01)

(52) U.S. Cl. ..... 417/437; 92/169.1

(58) Field of Classification Search ..... 417/437, 417/535–537
See application file for complete search history.

(56) References Cited

U.S. PATENT DOCUMENTS

| | | | | |
|---|---|---|---|---|
| 5,286,173 | A * | 2/1994 | Takenaka et al. | 417/269 |
| 6,190,144 | B1 | 2/2001 | Balma | |
| 7,074,020 | B2 | 7/2006 | Navarro | |
| 2005/0238509 | A1 * | 10/2005 | Lee | 417/420 |
| 2007/0154331 | A1 * | 7/2007 | Tomell et al. | 417/312 |

FOREIGN PATENT DOCUMENTS

| | | | |
|---|---|---|---|
| CH | 254 487 | A | 5/1948 |
| DE | 1 083 480 | B | 6/1960 |
| DE | 10 2004 052 168 | A1 | 5/2006 |

* cited by examiner

*Primary Examiner* — Anh Mai
*Assistant Examiner* — Brenitra M Lee
(74) *Attorney, Agent, or Firm* — Hudak, Shunk & Farine Co. LPA

(57) ABSTRACT

A piston compressor with at least one compression cylinder having a piston, and with one suction port and one pressure port is described. The suction port and the pressure port are arranged at one end face of the compression cylinder.

10 Claims, 4 Drawing Sheets

PISTON COMPRESSOR

FIELD OF THE INVENTION

The invention concerns a piston compressor with at least one compression cylinder having a piston, and with one pressure port and one suction port.

BACKGROUND OF THE INVENTION

The compression cylinders of such piston compressors, which are designed for pressures of around 20 bar to 450 bar, often are no longer fabricated as sand mold castings.

Forged steel blocks or, for low pressure ranges as far as borehole diameters of around 500 mm, also cast iron blocks, chill molds, or simple model casting blocks are used as semifinished blanks.

In this kind of cylinder design, all gas spaces and channels that are formed by the inserting of sand cores during customary model casting are introduced by sometimes costly boreholes or milling work during the mechanical fabrication.

Thus, e.g., for dual-action compression cylinders, the connection of the valve chambers at the top cover and crank side has to be produced by a longitudinal borehole.

These connection boreholes have to be closed gas-tight at the end face of the compression cylinder by covers—similar to the valve covers. This gas-tight design requires a costly design solution, especially at high operating pressures.

The suction and pressure ports are arranged in the region between the particular valve chambers or directly on the respective valve chambers. Access to the space around the compression cylinder is greatly impaired by the pressure and suction pipes leading away from the suction and pressure ports.

FIG. 1 shows a dual-action compression cylinder 10 of the prior art.

The compression cylinder 10 has a cylinder chamber 25 in the middle, in which the piston 30 is arranged to move in the longitudinal direction. On either side of the piston 30 are formed two compression spaces 20*a*, 20*b*. At the end face, this cylinder chamber 25 is closed gas-tight by a cylinder cover 13. The compression cylinder 10 has a suction port 18 in the cylinder wall 24 and opposite it a pressure port 19, each of them emerging into a connection channel 17*a* and 17*b*, respectively. At both ends of the connection channels 17*a*, 17*b*, extending in the lengthwise direction parallel to the lengthwise axis, are arranged valve chambers 15*a* to 15*d* with valves 16*a* to 16*d*, being connected to the cylinder chamber 25 by corresponding channels. For reasons of fabrication, the connection channels 17*a* and 17*b* are open at the end face to chambers 22*a* and 22*b*, adjacent to the valve chambers 15*b*, 15*c*. Thus, they must be closed by separate covers 14*a*, 14*b* at the front end face 12*a*. At the rear end face 12*b*, the cylinder space 25 is closed off by means of a cover 26 with a gasket for the piston rod 32. In another design, the cylinder space 25 is configured as a blind borehole. In this case, the piston rod is led through the cylinder bottom by means of a smaller borehole. Thus, the closing cover 26 is omitted.

The side ports 18 and 19 have a considerable influence on the outer dimensions of the compression cylinder 10. Major drawbacks of this design are large size of the semifinished blanks and greatly impaired access when the compressor layout is arranged vertically. For horizontal compressors, whose compression cylinders are often braced against the foundation, the tanks lying underneath the pressure pipe often hinder this bracing.

SUMMARY OF THE INVENTION

The problem of the invention is therefore to provide a compressor that is more compact and space-saving, as well as more economical.

This problem is solved with a compressor which is characterized in that the pressure port and the suction port are arranged at one end face of the compression cylinder.

Thanks to the altered arrangement of the suction and pressure ports, both the length of the compression cylinder and the piston are considerably shortened, which correspondingly reduces the acquisition costs of the semifinished blanks. The same holds for the cylinder liner and the piston rod.

Thanks to the small mass of the cylinder and the small piston mass due to the shorter cylinder, both the static loading for the foundation and the dynamically acting mass forces of the machine are considerably reduced.

Especially in the case of vertical compressor layouts, the arrangement of suction and pressure ports according to the invention can alter the pipe laying enough to make available sufficient work space for inspection and installation jobs.

Preferably, the compression cylinder has a piston rod arranged at one end of the piston, and the pressure port and the suction port are arranged at the end face of the compression cylinder away from that of the piston rod. The ports lie in a freely accessible end face, namely, the front end face of the compression cylinder, which further simplifies the laying of pipelines.

Preferably, the compression cylinder is a dual-acting compression cylinder.

In this embodiment, the compression cylinder preferably has at suction end and pressure end two valve chambers each, spaced apart in the direction of the cylinder axis, being joined together by a connection channel closed off against the outside. By a connection channel closed off against the outside is meant a channel which is not accessible, e.g., through side boreholes or channels. Each valve chamber at the pressure end is connected via a port chamber to the pressure port and each valve chamber at the suction end via a port chamber to the suction port.

Thanks to eliminating the ports provided at the side in the cylinder wall, the connection channels, the cylinder chambers and the pistons can have much shorter configuration. Shortening of 20% to 30% is possible.

The moving of the ports to the end face can be utilized for a distinctly more compact design, especially in the case of dual-action compression cylinders.

Preferably, the compression cylinder consists of steel, especially forged steel, and the connection channel and the port chamber are formed by a single borehole. The fabrication process is considerably simplified, because the additional fabrication of separate pipeline ports in the cylinder wall is eliminated.

Compressors with such compression cylinders consisting of forged steel are used preferably in pressure ranges of 100 bar to 450 bar.

According to another embodiment, the compression cylinder consists of a cast iron block. The connection channels and the port chambers are also fabricated here by machining in accordance with the steel cylinder.

Compressors with such compression cylinders are used preferably in the range of 20 bar to 99 bar.

The cost reduction achieved by the altered arrangement of the suction and pressure ports can be further boosted in that the connection channels are merely precast by simple model casting, but no longer machined.

The cylinders of the invention can be used in horizontal, vertical, as well as V-shaped compressors.

Such compressors are used in the compression of all gases, preferably in the chemical, petrochemical and pharmaceutical industry, as well as in petroleum storage.

BRIEF DESCRIPTION OF THE DRAWINGS

Advantageous embodiments shall be explained more closely below by means of the drawings.

These show.

DETAILED DESCRIPTION OF THE INVENTION

Figure 2:
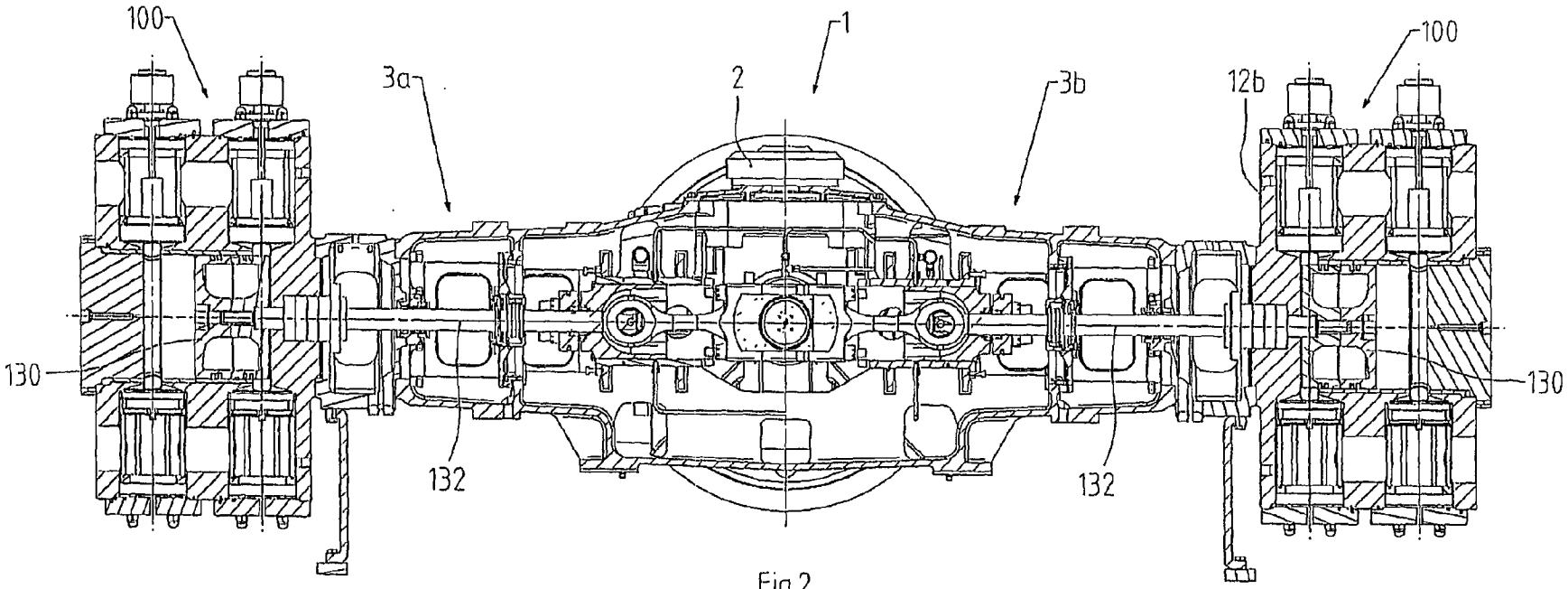
FIG. 2, a schematic representation of a horizontal compressor in cross section, FIG. 3, a cross section through a compression cylinder shown in FIG. 2 with installed piston and piston rod, FIG. 4, a vertical compressor in side view.

In FIG. 2, a horizontal compressor 1 is shown, having in the middle a crank mechanism 2 driven by a motor and adjacent thereto at the sides two compression units, each consisting of so-called intermediate pieces 3*a*, 3*b* and a dual-acting compression cylinder 100, having two compression spaces 120*a, b* on either side of the piston 130.

The compression cylinders 100 each have one piston 130 in the cylinder chamber 125 that is connected to the drive mechanism 2 by a piston rod 132.

Figure 1:
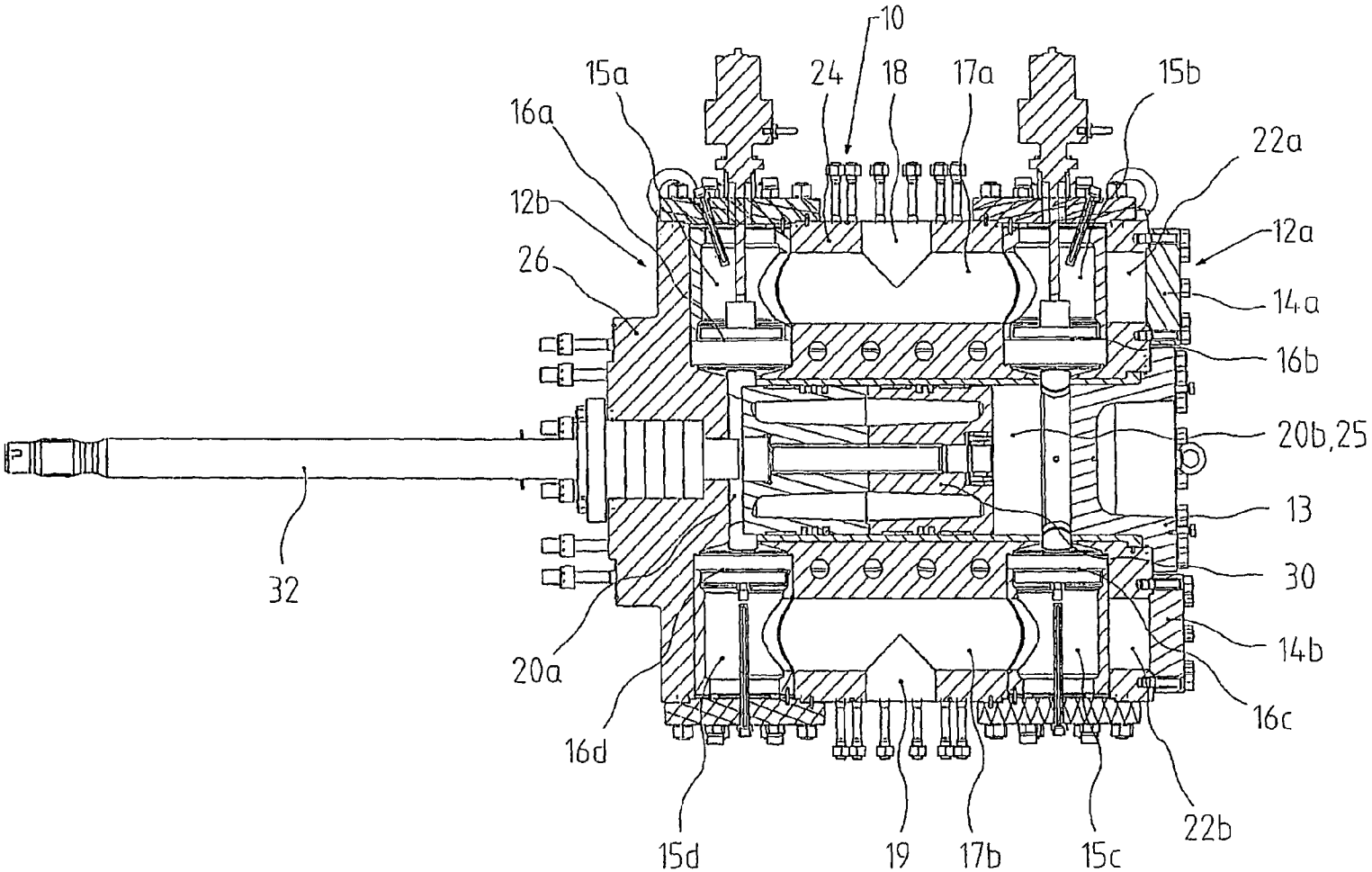
FIG. 1, a compression cylinder according to the prior art
Figure 3:
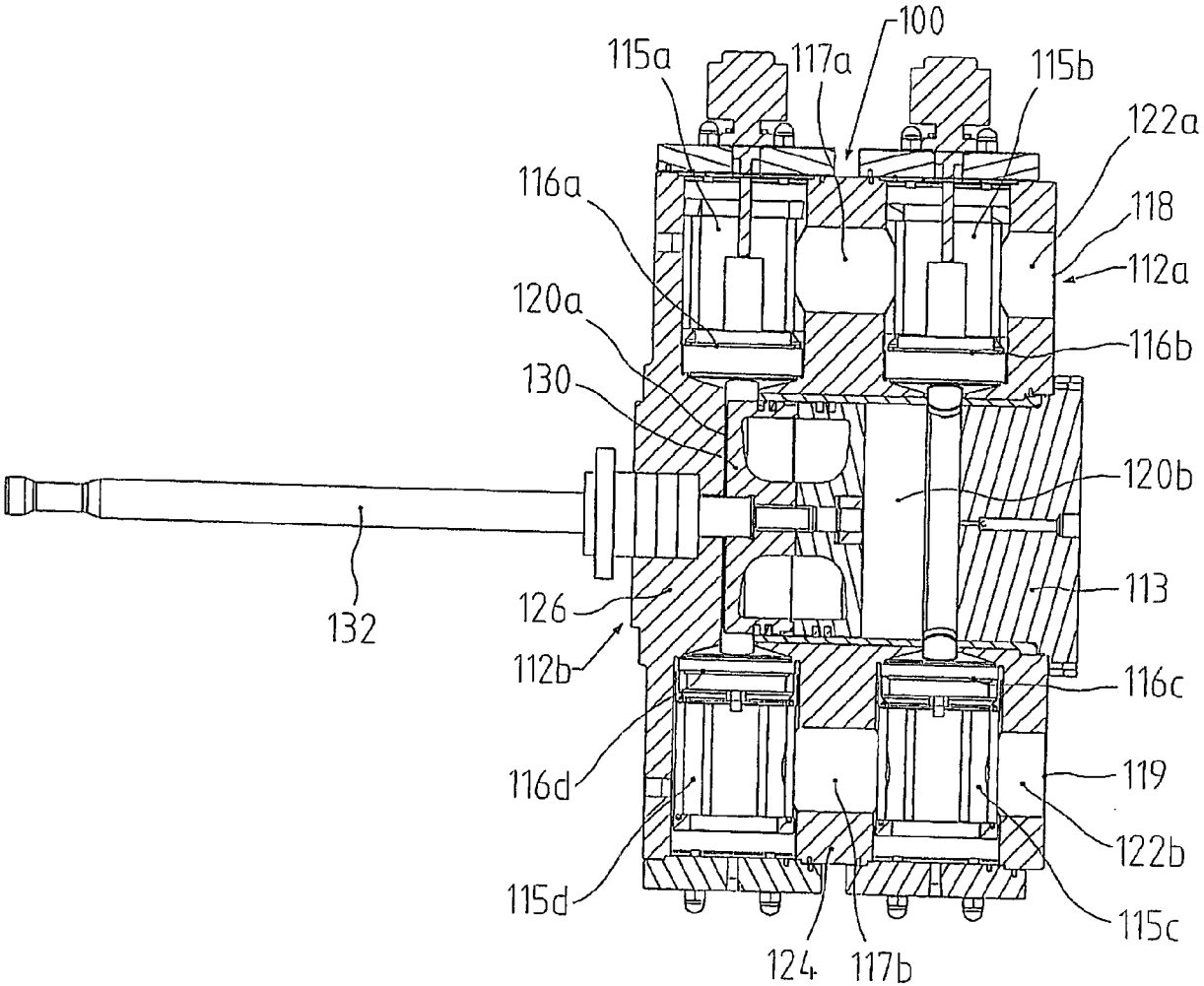

The compression cylinder 100 is shown enlarged in FIG. 3. As can be seen, the compression cylinder 100 is considerably shorter in configuration than is the case with the compression cylinder 100 of the prior art in FIG. 1. The shortening here amounts to around 23%.

In the cylinder wall 124 are the valve chambers 115*a* to 115*d* with the valves 116*a* to 116*d*.

In the upper part of the diagram of FIG. 3 is the suction-side arrangement of the valve chambers 115*a*, 115*b* with the suction-side port 118. The two valve chambers 115*a* and 115*b* are joined together by means of the connection channel 117*a*, which is closed off from the outside. In the solution of the invention, it is not necessary to provide the suction port in the region of the connection channel 117*a*. The valve chambers 115*a*, 115*b* are closed by valve covers, not shown. As a prolongation of the connection channel 117*a* is situated the port chamber 122*a*, which ends at the suction port 118.

In the lower part of the diagram of FIG. 3 is shown the pressure-side arrangement of the valve chambers 115*c* and 115*d*. These two chambers are also joined together by a connection channel 117*b*. This channel also is closed off from the outside. Also as a prolongation is situated the port chamber 122*b* and the pressure-side port 119.

The compression cylinder 100 shown in FIG. 3 can be made from a steel block, for example. The connection channels 117*a, b* as well as the chambers 122*a* and 122*b* are each introduced by a single borehole from the front end face 112*a*. Thus, no additional boreholes are needed for the pressure port and the suction port.

The cylinder chamber 125 is closed by the cylinder cover 113.

The rear end face 112*b* is designed as a solid cylinder bottom 126 without cover, with a receiving borehole for the piston rod gasket, not shown here.

Figure 4:
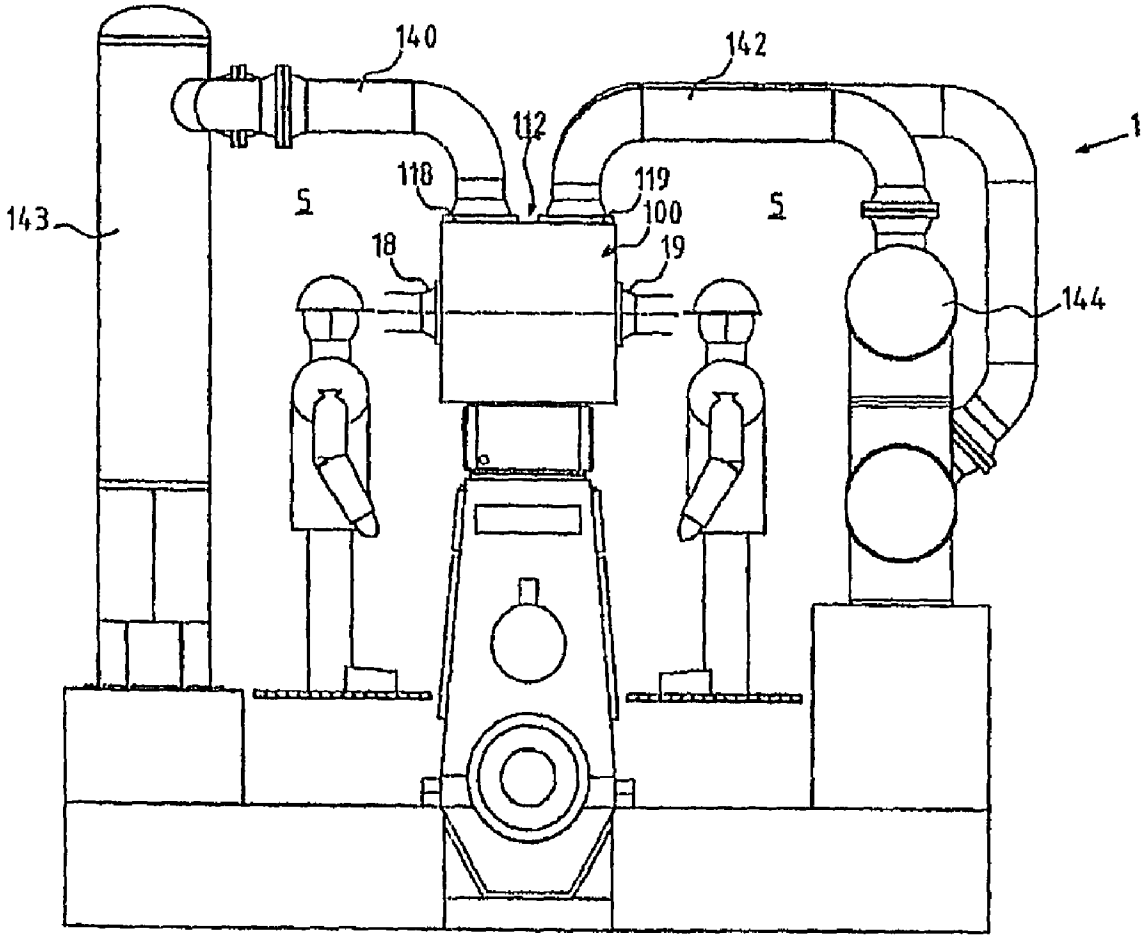

FIG. 4 shows a side view of a vertical compressor 1. The compression cylinder 100 projects vertically upward and has the suction port 118 and the pressure port 119 at the front end face 112*a*. From these ports 118 and 119, the corresponding suction and pressure pipes 140, 142 emerge upward, so that the space 5 surrounding the compression cylinder 100 is considerably enlarged, and thus attending personnel can stand upright there to perform maintenance tasks. The suction and pressure ports 18 and 19 provided in the prior art are shown by broken lines in FIG. 4. Furthermore, FIG. 4 shows the suction pulsation dampener 143 provided for the compressor stage and the heat exchanger 144 needed to cool down the compressed gas.

| List of reference symbols | |
|---|---|
| 1 | piston compressor |
| 2 | crank mechanism |
| 3a, b | intermediate piece |
| 5 | surrounding space |
| 10, 100 | compression cylinder |
| 12a, 112a | front end face |
| 12b, 112b | rear end face |
| 13, 113 | cylinder cover |
| 14a, b | cover |
| 15a-d, 115a-d | valve chamber |
| 16a-d, 116a-d | valve |
| 17a, b, 117a, b | connection channel |
| 18, 118 | suction port |
| 19, 119 | pressure port |
| 20a, b, 120a, b | compression space |
| 22a, b | chamber |
| 122a, b | port chamber |
| 24, 124 | cylinder wall |
| 25, 125 | cylinder chamber |
| 26 | cover |
| 126 | cylinder bottom |
| 30, 130 | piston |
| 32, 132 | piston rod |
| 140 | suction pipe |
| 142 | pressure pipe |
| 143 | suction pulsation dampener |
| 144 | heat exchanger |

What is claimed is:

1. A piston compressor comprising: at least one compression cylinder having a piston, and with one suction port and one pressure port, wherein the suction port and the pressure port are arranged at one end face of the compression cylinder, wherein the compression cylinder is a dual-acting compression cylinder, and wherein the compression cylinder has at suction end and pressure end two valve chambers each, spaced apart in the direction of the cylinder axis, each being joined together by a connection channel closed off against the outside, and each valve chamber at the suction end is connected via a connection channel to the suction port and each valve chamber at the pressure end via a connection channel to the pressure port.

2. The piston compressor according to claim 1, wherein the compression cylinder has a piston rod arranged at one end of the piston, and the suction port and the pressure port are arranged at the end face of the compression cylinder away from that of the piston rod.

3. The piston compressor according to claim 1, wherein the compression cylinder consists of steel, and the connection channel and the port chamber are formed by a single borehole.

4. The piston compressor according to claim 1, wherein the compression cylinder consists of a cast iron block and the connection channels and the port chambers are formed by a single borehole.

5. The piston compressor according to claim 2, wherein the compression cylinder is a dual-acting compression cylinder.

6. The piston compressor according to claim 5, wherein the compression cylinder has at suction end and pressure end two valve chambers each, spaced apart in the direction of the cylinder axis, each being joined together by a connection channel closed off against the outside, and each valve chamber at the suction end is connected via a connection channel to the suction port and each valve chamber at the pressure end via a connection channel to the pressure port.

7. The piston compressor according to claim 6, wherein the compression cylinder consists of steel, and the connection channel and the port chamber are formed by a single borehole.

8. The piston compressor according to claim 2, wherein the compression cylinder consists of a cast iron block and the connection channels and port chambers are formed by a single borehole.

9. The piston compressor according to claim 3, wherein the steel is forged steel.

10. The piston compressor according to claim 7, wherein the steel is forged steel.

* * * * *